US006799979B1

(12) United States Patent
Huang

(10) Patent No.: US 6,799,979 B1
(45) Date of Patent: Oct. 5, 2004

(54) ELECTRICAL CONNECTOR ASSEMBLY HAVING LOCKING DEVICE

(75) Inventor: Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/407,722

(22) Filed: Apr. 3, 2003

(30) Foreign Application Priority Data

Mar. 19, 2003 (JP) ..... 92204266

(51) Int. Cl.[7] ..... H01R 9/09
(52) U.S. Cl. ..... 439/74
(58) Field of Search ..... 439/74, 342, 330–331, 439/70–73, 525–526

(56) References Cited

U.S. PATENT DOCUMENTS 4,330,163 A * 5/1982 Aikens et al. ..... 439/71
4,637,670 A * 1/1987 Coller et al. ..... 439/180
5,073,116 A * 12/1991 Beck, Jr. ..... 439/71
5,395,265 A 3/1995 DiMondi et al.
5,836,773 A 11/1998 McHugh et al.
5,876,217 A 3/1999 Ito et al.
6,217,361 B1 * 4/2001 Murr ..... 439/342
6,475,010 B1 11/2002 Yu

* cited by examiner

*Primary Examiner*—Ross Gushi
*Assistant Examiner*—Phuongchi Nguyen
(74) *Attorney, Agent, or Firm*—Wei Te Chung

(57) ABSTRACT

An electrical connector assembly (1) includes a first connector (2) and a second connector (3) engageable with the first connector. The first connector has a first dielectric housing (20) defining a pair of receiving spaces (202), a number of first terminals (22) received in the first housing and a pair of latches (24) retained in the receiving spaces. Each latch includes a retaining portion (242), an intermediate portion (243) connecting with the retaining portion and a spring portion (26) extending from the intermediate portion. The second connector comprises a second dielectric housing (30) defining an engaging portion to engage with the spring portion and a number of second terminals (32) received in the second dielectric housing and electrically connecting with the first terminals.

4 Claims, 6 Drawing Sheets

ELECTRICAL CONNECTOR ASSEMBLY HAVING LOCKING DEVICE

CROSS-REFERENCE TO RELATED APPLICATIONS

Relevant subject matter is disclosed in a copending application filed on Mar. 20, 2003 and entitled "ELECTRICAL CONNECTOR ASSEMBLY HAVING LOCKING DEVICE" which is invented by the same inventor as this patent application and assigned to the same assignee with this application.

BACKGROUND OF THE INVENTION

1. Field of the Invention

The present invention relates to an electrical connector assembly, and particularly to an electrical connector assembly having a locking device for securing two mated connectors thereof together.

2. Description of Related Art

It is well known that a board-to-board connector assembly is widely used for connecting two printed circuit boards (PCBs) together and includes a plug connector mounted on a first PCB and a receptacle connector mounted on a second. PCB and electrically connected with the plug connector. The connector assembly is often equipped with a locking device for ensuring a reliable connection between the receptacle connector and the plug connector, thereby ensuring a reliable signal transmission between the PCBs.

U.S. Pat. No. 5,876,217, issued to Ito et al., discloses a connector assembly including a plug connector and a receptacle connector. The plug connector includes an insulative housing defining a plurality of recesses and the receptacle connector includes a plurality of terminals each having a locking portion. In assembly, the locking portion of each terminal of the receptacle connector engages with the corresponding recess of the housing of the plug connector, whereby the plug connector and the receptacle connector securely engage with each other. However, the terminal having the locking portion is difficult to manufacture. Furthermore, because each terminal of the receptacle is subject to a retaining force between the locking portion thereof and the corresponding recess of the housing of the plug connector, repeated engagement between the plug and the receptacle connectors may result in the terminals being deformed so that the performance of the signal transmission is adversely affected.

U.S. Pat. No. 5,836,773, issued to McHugh et al., discloses a board-to-board connector assembly with a locking device. The locking device includes a protrusion formed on a sidewall of an insulative housing of a plug connector and a cutout defined in a sidewall of an insulative housing of a receptacle connector. By the engagement of the protrusion and the cutout, the plug connector stably mates with the receptacle connector to ensure a reliable signal transmission therebetween. Because the protrusion and the sidewall around the cutout are made of plastic material, the protrusion and the cutout engage with each other via their inherent characteristic, a long-term engagement therebetween will cause plastic deformation and this deformation can never resume. As a result, the protrusion cannot reliably engage with the cutout.

U.S. Pat. No. 5,395,265, issued to DIMondi et al., discloses a board-to-board connector assembly including a plug connector, a receptacle connector and an additional locking device. The locking device includes two pairs of metal latches respectively assembled on opposite sides of the plug connector and the receptacle connector. The metal latch on the plug connector locks with the corresponding metal latch on the receptacle connector so that the plug connector securely connects with the receptacle connector. However, the locking device requires two pairs of metal latches, thereby wasting the materials and increasing the cost of manufacture.

Hence, an electrical connector assembly with an improved locking device is desired to overcome the disadvantages and problems of the prior art.

SUMMARY OF THE INVENTION

An object of the present invention is to provide an electrical connector assembly having an improved locking device for ensuring a reliable engagement between a plug and a receptacle connectors thereof.

To achieve the above object, an electrical connector assembly in accordance with the present invention comprises a first connector and a second connector engageable with the first connector. The first connector comprises a first dielectric housing, a plurality of first terminals received in the first dielectric housing and a latch assembled on the first dielectric housing. The dielectric housing comprises an end wall defining a receiving space. The latch comprises a retaining portion retained in the receiving space, an intermediate portion connecting to the retaining portion and a spring portion extending upwardly from the intermediate portion. The second connector comprises a second dielectric housing comprising an engaging portion to engage with the spring portion and a plurality of second terminals received in the second dielectric housing and electrically connecting with the first terminals.

Other objects, advantages and novel features of the invention will become more apparent from the following detailed description when taken in conjunction with the accompanying drawings.

DETAILED DESCRIPTION OF THE INVENTION

Figure 1:
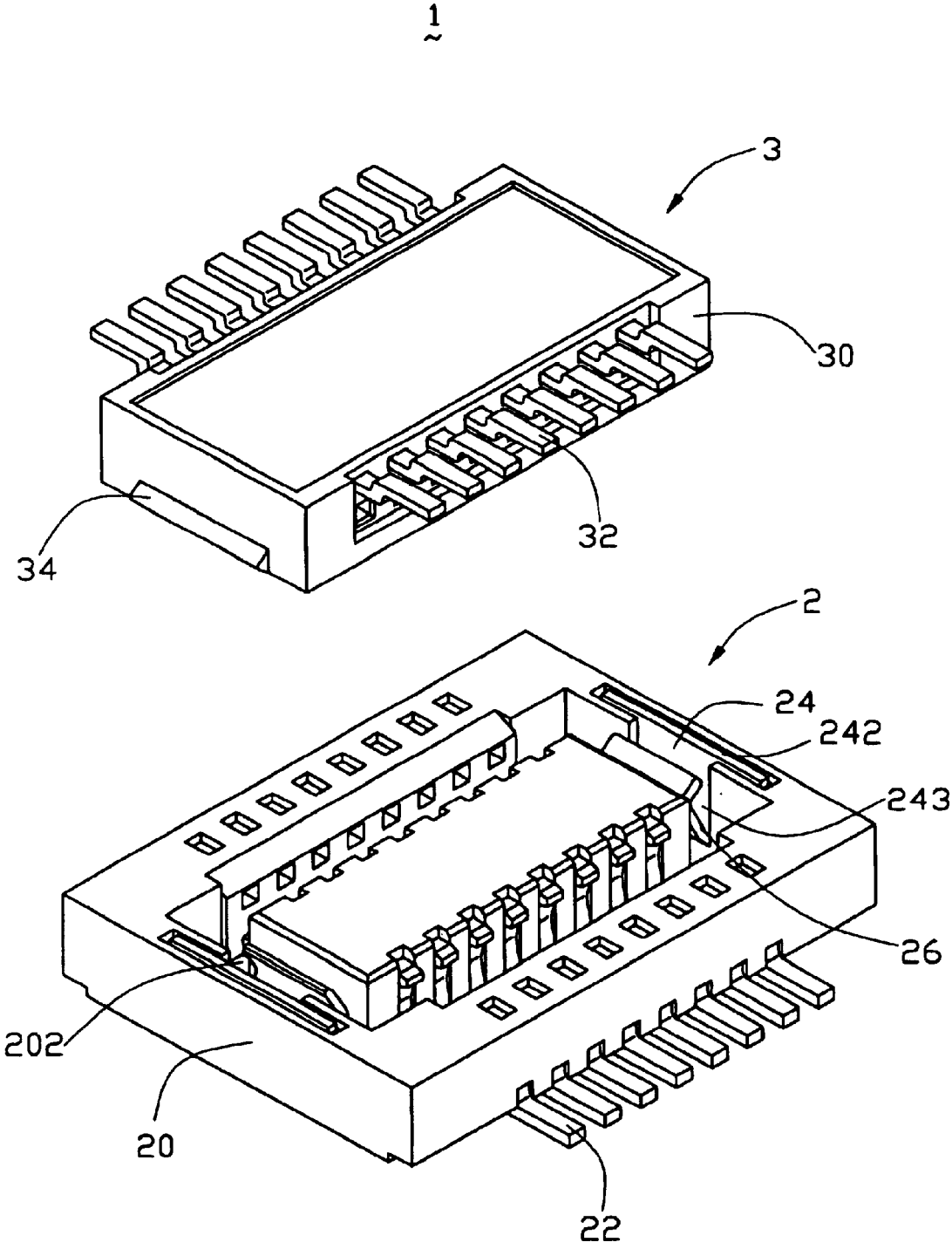
FIG. 1 is an exploded perspective view of an electrical connector assembly in accordance with the present invention.

Referring to FIG. 1, an electrical connector assembly 1 in accordance with the present invention comprises a first connector 2 and a second connector 3 respectively mounted on a first and a second printed circuit boards (not shown). The first connector 2 comprises a first dielectric housing 20, a plurality of first terminals 22 received in the first dielectric housing 20 and a pair of metallic latches 24 retained in the first dielectric housing 20. The second connector 3 comprises a second dielectric housing 30 and a plurality of second terminals 32 received in the second dielectric housing 30 for electrically connecting with the corresponding first terminals 22. The first terminals 22 and the second terminals 32 are respectively soldered to the first and the second printed circuit boards, whereby the first connector 2 and the second connector 3 are securely mounted on the first and the second printed circuit boards.

Figure 2:
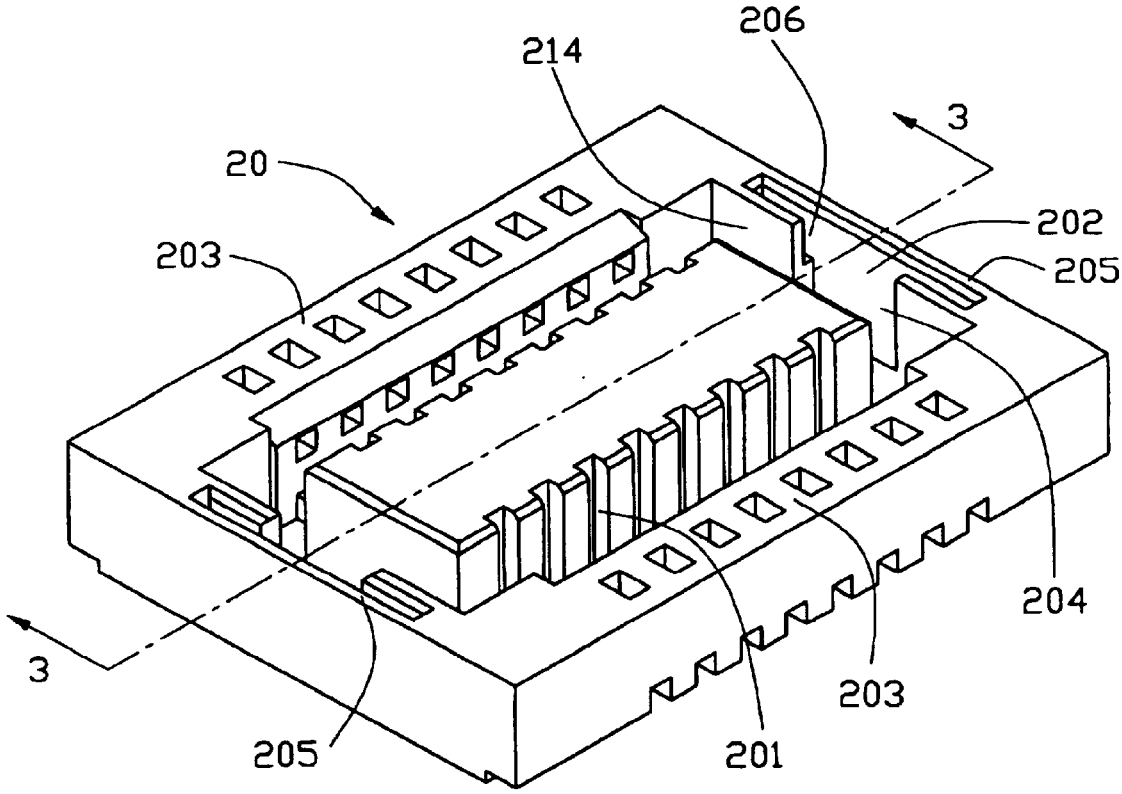
FIG. 2 is a perspective view of a first dielectric housing of a first connector shown in FIG. 1.
Figure 3:
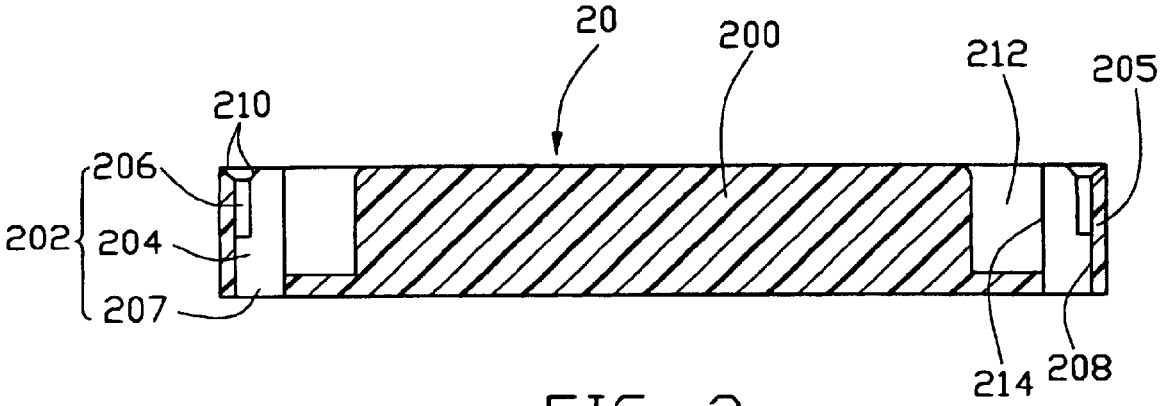
FIG. 3 is a cross-sectional view taken along line 3—3 of FIG. 2.

Referring to FIGS. 2–3, the first dielectric housing 20 comprises a central portion 200, a pair of end walls 205 and a pair of side walls 203 connecting to the end walls 205. The central potion 200, the end walls 205 and the sidewalls 203 together define an engaging space 212 therebetween for receiving a corresponding portion of the second connector 3. The first dielectric housing 20 defines a plurality of channels 201 communicating with the engaging space 212 and receiving the corresponding first terminals 22 therein. Each end wall 205 defines a receiving space 202 communicating with the engaging space 212 for receiving the corresponding latch 24 therein. The receiving space 202 includes a cutout 204 in a middle portion of an inner side face 214 of the end wall 205, an upper indentation 206 and a lower slot 207 both communicating with the cutout 204. The end wall 205 defines a first lead-in 210 on a top end of the receiving space 202 for facilitating and guiding the insertion of the latch 24 into the receiving space 202.

Figure 4:
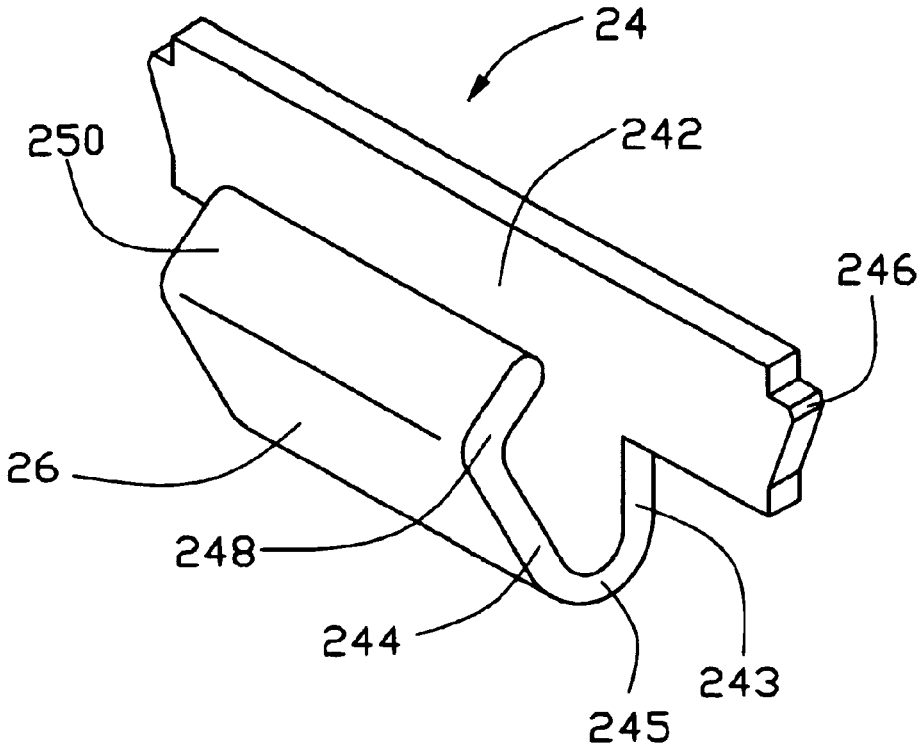
FIG. 4 is an enlarged perspective view of a latch of the first connector shown in FIG. 1.
Figure 5:
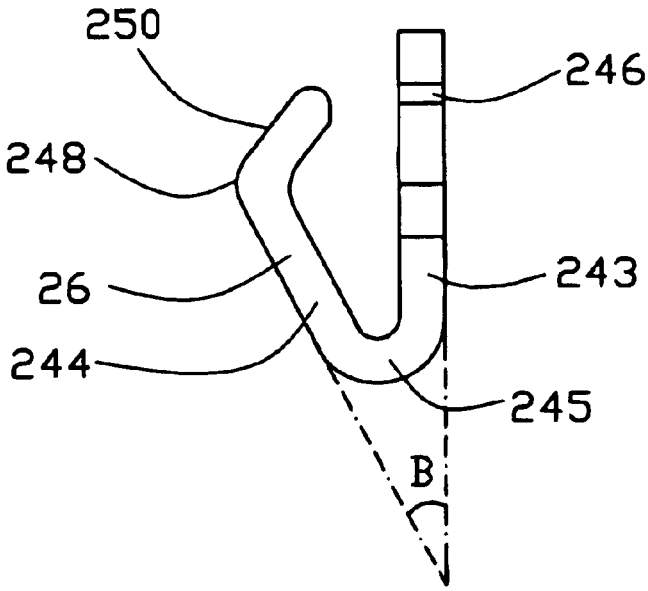
FIG. 5 is a side view of the latch of FIG. 4.

Referring to FIGS. 4–5, each latch 24 comprises an elongated retaining portion 242, an intermediate portion 243 downwardly extending from a bottom of the retaining portion 242 and a spring portion 26 extending upwardly and outwardly from a bottom of the intermediate portion 243. The retaining portion 242 is formed with a plurality of barbs 246 on opposite longitudinal ends thereof. The spring portion 26 comprises a curved portion 245 connected with the intermediate portion 243, a first contacting portion 244 extending upwardly and outwardly from the curved portion 245, a second contacting portion 248 curvedly connected with the first contacting portion 244 and a guiding portion 250 extending upwardly and inwardly from the second contacting portion 248. The first contacting portion 244 is formed with an acute angle B with respect to the intermediate portion 243. Also referring to FIG. 1, the latch 24 is guided into the receiving space 202 of the first dielectric housing 20 via the first lead-in 210 of the end wall 205. The retaining portion 242 is received in the indentation 206 with the barbs 246 interferentially engaging with inner sides of the indentation 206. The intermediate portion 246 abutting against an inner wall 208 of the cutout 204 is received in the cutout 204. The curved portion 245 is received in the lower slot 207 of the receiving space 202. The first contacting portion 244, the second contacting portion 248 and the guiding portion 250 all protrude into the engaging space 212 of the first dielectric housing 20 to engage with the second connector 3.

Figure 6:
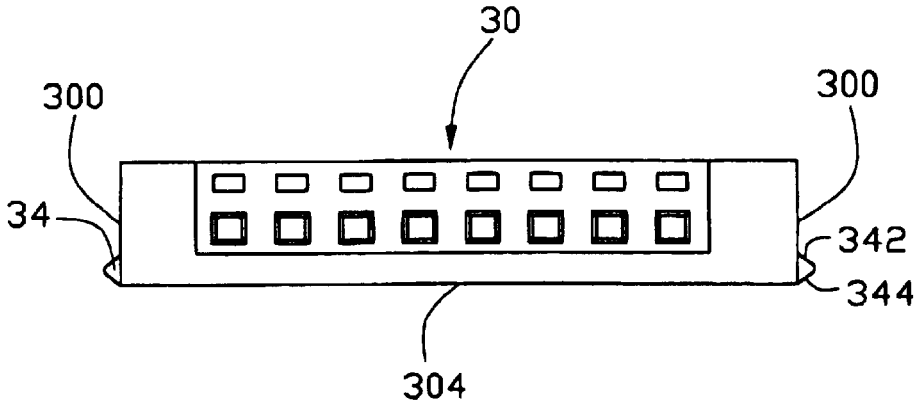
FIG. 6 is a side view of a second dielectric housing of a second connector shown in FIG. 1.

Referring to FIG. 6, the second dielectric housing 30 defines a pair of opposite side faces 300 and a mating face 304 connecting with the side faces 300. The second dielectric housing 30 is formed with a pair of projected ribs 34 on the side faces 300 adjacent to the mating face 304 of the second dielectric housing 30. Each projected rib 34 defines a second lead-in 344 adjacent to the mating surface 304 and a contacting face 342 opposite to the second lead-in 344. The second lead-in 344 facilitates the insertion of the second connector 3 into the first connector 2.

Figure 7:
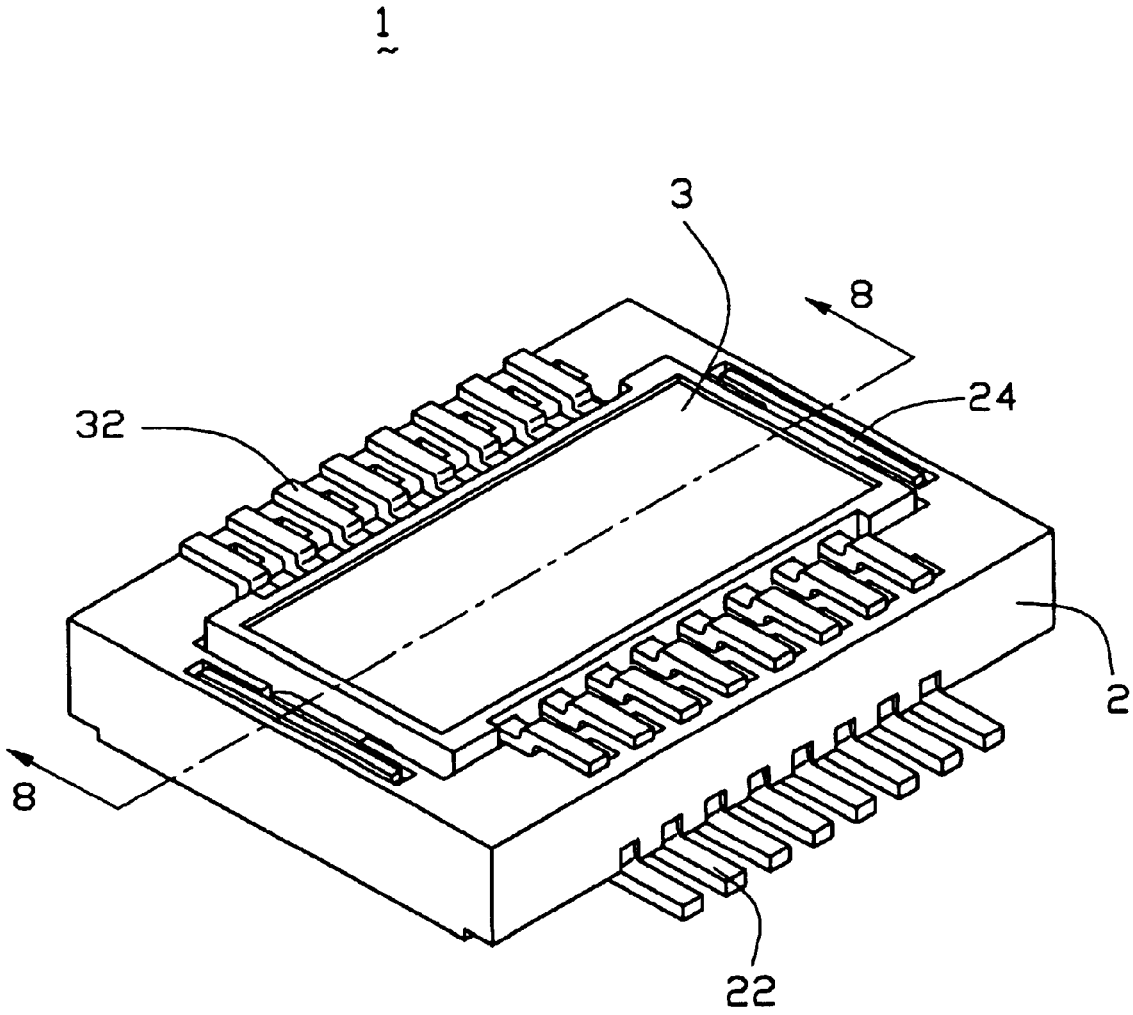
FIG. 7 is a view similar to FIG. 1 but the first and the second connectors have been mated with each other.
Figure 8:
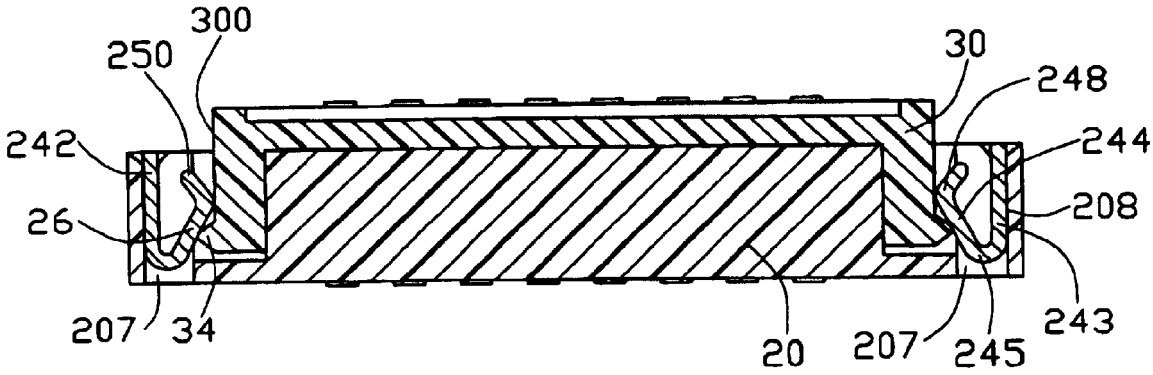
FIG. 8 is a cross-sectional view taken along line 8—8 of FIG. 7.

Referring to FIGS. 7–8, when the first connector 2 engages with the second connector 3, the intermediate portion 243 of the latch 24 snugly abuts against the inner side wall 208 of the cutout 204, the spring portion 26 of the latch 24 is pressed by the projected rib 34 to spring inwardly. The angle B becomes smaller due to the inward movement of the spring portion 26. Thus the projected rib 34 of the second dielectric housing 30 slides across the guiding portion 250 of the latches 24 via the second lead-in 308. The second contacting portion 248 abuts against the side face 300 of the second dielectric housing 30, the first contacting portion 244 of the latch 24 abuts against the contacting face 342 of the projected rib 34, whereby a reliable connection is ensured between the first connector 2 and the second connector 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

first and second mated connectors, the first connector including a first insulative housing defining a frame-like engaging space;

a pair of receiving spaces formed in two opposite end walls of the first housing, respectively;

a pair of cutouts formed in the corresponding end walls of the first housing, respectively, to communicate the corresponding receiving spaces to the engaging space;

a pair of latches retainably disposed in the corresponding receiving spaces, respectively, each of said latches including an upward curved portion at a lowest end with a contact portion upwardly extending therefrom and a guiding portion located on a top of the contact portion wherein the contact portion and a main portion of the guiding portion laterally extending through the corresponding cutout and into the engaging space while a tip of the guiding portion constantly hidden in the corresponding end wall;

the second connector including a second insulative housing received in the engaging space;

a pair of projected ribs formed on opposite end walls of the second housing and detachably latched with the contact portions of the corresponding latches, respectively.

2. The electrical connector assembly as claimed in claim 1, wherein the first insulative housing defines a pair of slots in two opposite end walls thereof below a bottom face of the engaging space and communicating with corresponding cutouts to receive corresponding curved portions of the latches, respectively.

3. The electrical connector assembly as claimed in claim 1, wherein the projected rib defines a lead-in adjacent to a bottom face of the second dielectric housing.

4. The electrical connector assembly as claimed in claim 1, wherein each latch comprises a retaining portion formed with a plurality of barbs on opposite ends thereof for interferentially engaging with inner sides of the receiving space.

* * * * *